US009372026B2

(12) United States Patent
Park et al.

(10) Patent No.: US 9,372,026 B2
(45) Date of Patent: Jun. 21, 2016

(54) REFRIGERATOR

(71) Applicant: Samsung Electronics Co., Ltd., Suwon-si (KR)

(72) Inventors: Ho Sang Park, Gwangju (KR); Kwon Chul Yun, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/730,571

(22) Filed: Jun. 4, 2015

(65) Prior Publication Data

US 2016/0025405 A1 Jan. 28, 2016

(30) Foreign Application Priority Data

Jul. 23, 2014 (KR) ..... 10-2014-0093274

(51) Int. Cl.
*F25D 23/00* (2006.01)
*F25D 23/06* (2006.01)

(52) U.S. Cl.
CPC ..... *F25D 23/063* (2013.01); *F25D 23/065* (2013.01); *F25D 23/067* (2013.01); *F25D 2201/12* (2013.01)

(58) Field of Classification Search
CPC ..... F16B 37/042; F16B 21/04; F25D 23/065; F25D 23/067; F25D 23/006; F25D 23/064; F25D 11/00; F25D 2201/12
USPC ..... 411/349, 549; 312/406, 406.1, 400, 401
See application file for complete search history.

(56) References Cited

U.S. PATENT DOCUMENTS 2,826,388 A * 3/1958 Janos ..... A47B 96/068 248/222.52
3,179,367 A * 4/1965 Rapata ..... A47B 57/52 248/222.52
3,404,596 A * 10/1968 Ryder ..... F16B 13/061 411/36
3,469,493 A * 9/1969 Fisher ..... F16B 9/02 248/239
3,826,458 A * 7/1974 Fisher ..... F16B 13/04 248/239
4,107,833 A * 8/1978 Knight ..... E04H 5/10 220/592.1

(Continued)

FOREIGN PATENT DOCUMENTS

DE 296 16 623 11/1996
DE 10 2008 005127 7/2009

(Continued)

OTHER PUBLICATIONS

European Search Report, Application No. 15172971.2-1605 dated Nov. 24, 2015 (8 pages).

*Primary Examiner* — Janet M Wilkens
(74) *Attorney, Agent, or Firm* — Staas & Halsey LLP

(57) ABSTRACT

A refrigerator having an improved structure of screw fastening portions to which screws disposed in a storage compartment are fastened so that an insulating material with which a space between an inner case and an outer case is filled can be prevented from leaking into the storage compartment includes an inner case; an outer case; an insulating material with which a space between the inner case and the outer case is filled; screws that fix components disposed in the storage compartment to the inner case; screw fixing members that are coupled to an outer surface of the inner case; and screw fastening portions disposed in the inner case, the screw fastening portions having a blocking layer that blocks the storage compartment from the outside of the inner case and is penetrated by the screws when the screws are fastened to the screw fastening portions.

16 Claims, 10 Drawing Sheets

(56) References Cited

U.S. PATENT DOCUMENTS

| | | | | | |
|---|---|---|---|---|---|
| 4,325,178 | A * | 4/1982 | Pruehs | B23P 11/00 | 24/305 |
| 4,647,263 | A * | 3/1987 | Macfee, Jr. | F16B 37/048 | 411/174 |
| 4,925,350 | A * | 5/1990 | Kolseth | B29C 70/745 | 411/520 |
| 7,731,315 | B2 * | 6/2010 | Lee | F25D 23/064 | 312/406 |
| 8,197,019 | B2 * | 6/2012 | Kim | F25D 23/067 | 312/401 |
| 2003/0143054 | A1 | 7/2003 | Kanie et al. | | |
| 2008/0180013 | A1 * | 7/2008 | Lee | F25D 23/064 | 312/406 |

FOREIGN PATENT DOCUMENTS

| | | | |
|---|---|---|---|
| EP | 1950513 | * | 7/2008 |
| FR | 2587770 | * | 3/1987 |
| GB | 1244271 | * | 8/1971 |
| JP | 6213559 | * | 8/1994 |
| KR | 1998 0067370 | | 12/1998 |
| KR | 20-1999-0027623 | | 7/1999 |
| KR | 10-2005-0080897 | | 8/2005 |
| WO | WO 98/13655 | * | 4/1998 |
| WO | WO 2005/078365 | * | 8/2005 |

* cited by examiner

REFRIGERATOR

CROSS-REFERENCE TO RELATED APPLICATIONS

This application claims the priority benefit of Korean Patent Application No. 10-2014-0093274, filed on Jul. 23, 2014 in the Korean Intellectual Property Office, the disclosure of which is incorporated herein by reference.

BACKGROUND

1. Field

The following description relates to a refrigerator having an improved structure of an inner case to which screw fixing members for fixing screws to be fastened to the inner case are coupled.

2. Description of the Related Art

In general, a refrigerator is an apparatus that includes a main body including an inner case and an outer case, a storage compartment formed by the inner case, and a cold air supplying unit for supplying cold air to the storage compartment, and keeps food fresh.

The temperature of the storage compartment is maintained to be in a predetermined range required to keep food fresh.

A front side of the storage compartment of the refrigerator is disposed to be opened, and the opened front side is closed by a door so that the temperature of the storage compartment can be maintained.

Various components are disposed in the storage compartment. These components are fixed into the storage compartment using screws.

The screws for fixing the components are fastened to the inner case, and screw fastening portions, to which the screws are fastened, are disposed in the inner case.

The screw fastening portions are disposed to cut the inner case so that a hole having a predetermined shape can be formed in the inner case. Screw fixing members for reinforcing the screw fastening portions are coupled to an outside of the inner case.

Thus, the screws fastened to the screw fastening portions inside the inner case are fixed by the screw fixing members.

A space between the inner case and the outer case is filled with an insulating material in a state in which the screw fixing members are coupled to the screw fastening portions. Because each of the screw fastening portions has the shape of the hole, the insulating material may leak into the storage compartment through the screw fastening portions.

In order to prevent leakage of the insulating material, a sealing operation including coating the screw fastening portions with hot melt, has to be separately performed. This causes an increase in cost due to an additional process.

SUMMARY

Therefore, it is an aspect of the present disclosure to provide a refrigerator having an improved structure of screw fastening portions to which screws disposed in a storage compartment are fastened so that an insulating material with which a space between an inner case and an outer case is filled can be prevented from leaking into the storage compartment.

Additional aspects of the disclosure will be set forth in part in the description which follows and, in part, will be obvious from the description, or may be learned by practice of the disclosure.

In accordance with an aspect of the present disclosure, a refrigerator includes an inner case having a storage compartment formed therein; an outer case that is coupled to an outside of the inner case and forms an exterior of the refrigerator; an insulating material with which a space between the inner case and the outer case is filled; screws that fix components disposed in the storage compartment to the inner case; screw fixing members that are coupled to an outer surface of the inner case and fix the screws fastened at an inside of the inner case; and screw fastening portions disposed in the inner case so that the screw fixing members are coupled to the screw fastening portions, the screw fastening portions having a blocking layer that blocks between the storage compartment and the outside of the inner case and is penetrated by the screws when the screws are fastened to the screw fastening portions.

Each of the screw fixing members may include a body portion, a coupling portion disposed to protrude from the body portion and coupled to each of the screw fastening portions, and a fixing groove disposed in the center of the coupling portion and the body portion so that each of the screws is inserted and fixed into the fixing groove.

The coupling portion may have an inclined surface, a cross section of which extends in a direction in which the screw fixing members are coupled to the screw fastening portions.

The coupling portion may include a first coupling portion that is in contact with the body portion and a second coupling portion that is spaced apart from the body portion and having the inclined surface between the first coupling portion and the second coupling portion.

A pair of inclined surfaces may be disposed to be symmetrical with each other so that the second coupling portion has a pair of hanging portions that protrude outwardly more than the first coupling portion in a radial direction of the fixing groove.

Each of the screw fastening portions may include a bead that protrudes convexly toward the outside of the inner case, a coupling groove disposed in the bead so that the coupling portion of each screw fixing member is inserted into and coupled to the coupling groove, and a blocking layer that forms a bottom surface of the coupling groove.

The coupling groove may have a shape corresponding to the second coupling portion so that the second coupling portion is capable of being inserted into the coupling groove, and the coupling groove may be disposed to be recessed by an interval between the first coupling portion and the second coupling portion.

Sides of the coupling groove may be formed to have flexibility and may be deformed to have a hanging groove corresponding to a shape of the inclined surface when the body portion is rotated after the coupling portion is inserted into the coupling groove.

When the screw fixing members are rotated and are coupled to the screw fastening portions, the pair of hanging portions may be hung in the hanging groove so that the screw fixing members are prevented from escaping from the screw fastening portions.

A space between the inner case and the outer case may be filled with the insulating material after the screw fixing members are coupled to the screw fastening portions.

The blocking layer may prevent the insulating material from leaking into the storage compartment.

When the screws are fastened to the screw fastening portions, the screws may penetrate through the blocking layer and may be inserted and fixed into the fixing groove.

In accordance with an aspect of the present disclosure, a refrigerator includes an inner case having a storage compartment formed therein; an outer case that is coupled to an outside of the inner case and constitutes an exterior of the refrigerator; an insulating material filled between the inner case and the outer case; screws that fix components disposed in the storage compartment to the inner case; screw fastening portions, each of which is disposed to have a coupling groove in the outside of the inner case; and screw fixing members that are coupled to the screw fastening portions and fix the screws that penetrate into the inner case that is a bottom surface of the coupling groove and are fastened to the screw fastening portions in the inner case, wherein each of the screw fixing members may have a coupling portion inserted into the coupling groove, and when the screw fixing members are rotated in a state in which the coupling portion is inserted into the coupling groove, the coupling portion may be fixed into the coupling groove so that the screw fixing members are prevented from escaping from the screw fastening portions.

Each of the screw fastening portions may include a bead that protrudes convexly toward the outside of the inner case, a coupling groove disposed in the bead to be recessed in a direction of an inside of the inner case, and a blocking layer that forms a bottom surface of the coupling groove.

Each of the screw fixing members may include a body portion, a coupling portion disposed to protrude from the body portion and coupled to the coupling groove, and a fixing groove disposed in the center of the coupling portion and the body portion so that each of the screws is inserted and fixed into the fixing groove.

The blocking layer may prevent the insulating material from leaking into the storage compartment.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
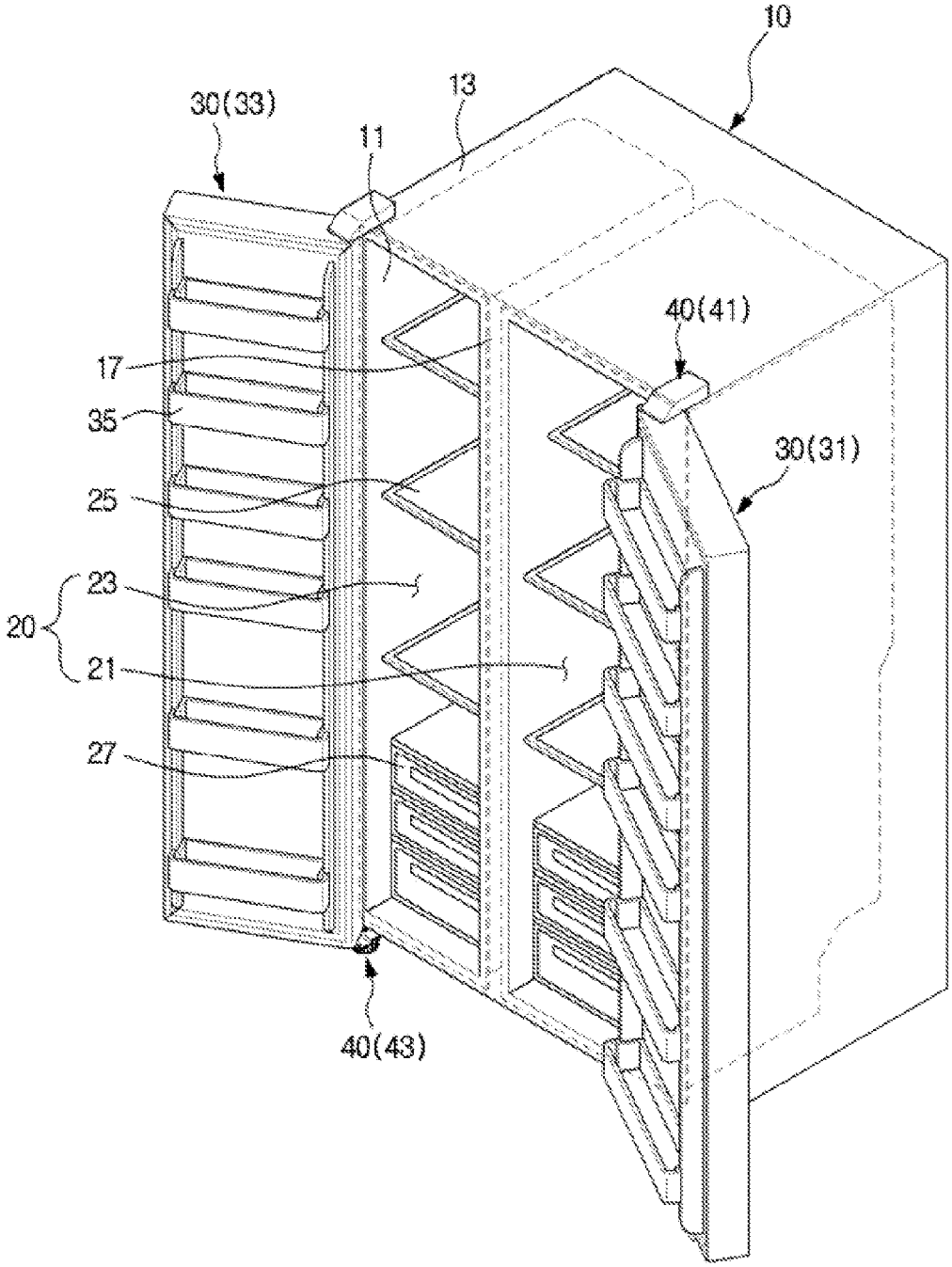
FIG. 1 is a perspective view of a refrigerator in accordance with an embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described in detail with reference to the accompanying drawings.

Figure 2:
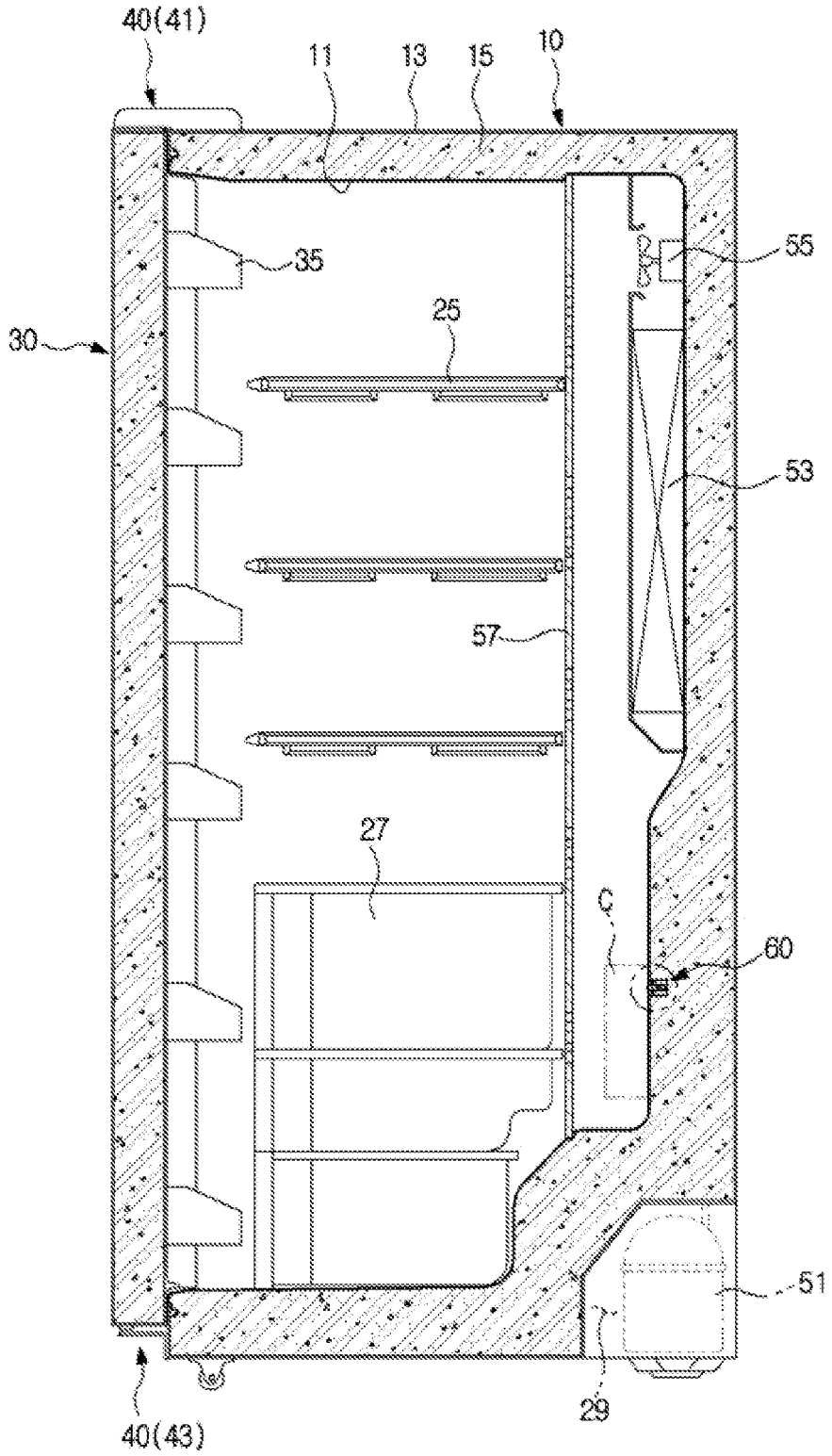
FIG. 2 is a cross-sectional view of the refrigerator in accordance with an embodiment of the present disclosure.

As illustrated in FIGS. 1 and 2, a refrigerator includes a main body 10 that forms an exterior of the refrigerator, a storage compartment 20 disposed in the main body 10 in such a way that a front side of the storage compartment 20 may be opened, a door 30 that is pivotally coupled to the main body 10 to open/close the front side of the storage compartment 20, and a hinge module 40 including an upper hinge 41 and a lower hinge 43 that allow the door 30 to be rotatably coupled to the main body 10.

The main body 10 includes an inner case 11 that defines the storage compartment 20, and an outer case 13 that forms an exterior of the main body 10. An insulating material 15 is foamed between the inner case 11 and the outer case 13 to prevent cold air in the storage compartment 20 from being discharged to the outside of the storage compartment 20.

Also, the main body 10 includes a barrier wall 17 that partitions the storage compartment 20 into a refrigerator compartment 21 and a freezer compartment 23 that are disposed on right and left sides of the main body 10, respectively. A machine compartment 29 in which a compressor 51 for compressing a refrigerant and a condenser (not shown) for condensing the compressed refrigerant are installed, is provided in a lower side of the rear of the main body 10.

The storage compartment 20 is partitioned by the barrier wall 17 into left and right portions. The refrigerator compartment 21 is disposed on the right side of the main body 10, and the freezer compartment 23 is disposed on the left side of the main body 10.

A plurality of shelves 25 and a storage container 27 may be disposed in the storage compartment 20 to store food.

The storage compartment 20 is opened/closed by the door 30 pivotally coupled to the main body 10. The refrigerator compartment 21 and the freezer compartment 23 partitioned by the barrier wall 17 into left and right portions are opened/closed by a refrigerator compartment door 31 and a freezer compartment door 33, respectively.

The refrigerator compartment door 31 and the freezer compartment door 33 may be pivotally coupled to the main body 10 by using the hinge module 40 including the upper hinge 41 disposed at an upper portion of the main body 10 and the lower hinge 43 disposed at a lower portion of the main body 10.

A plurality of door guards 35 are disposed in rear sides of the refrigerator compartment door 31 and the freezer compartment door 33 to accommodate food.

A cold air supplying unit may include the compressor 51 and the condenser that are installed in the machine compartment 29, an evaporator 53 and a blower fan 55 that are installed in a rear side of the storage compartment 20, and a cold air duct 57.

Figure 3:
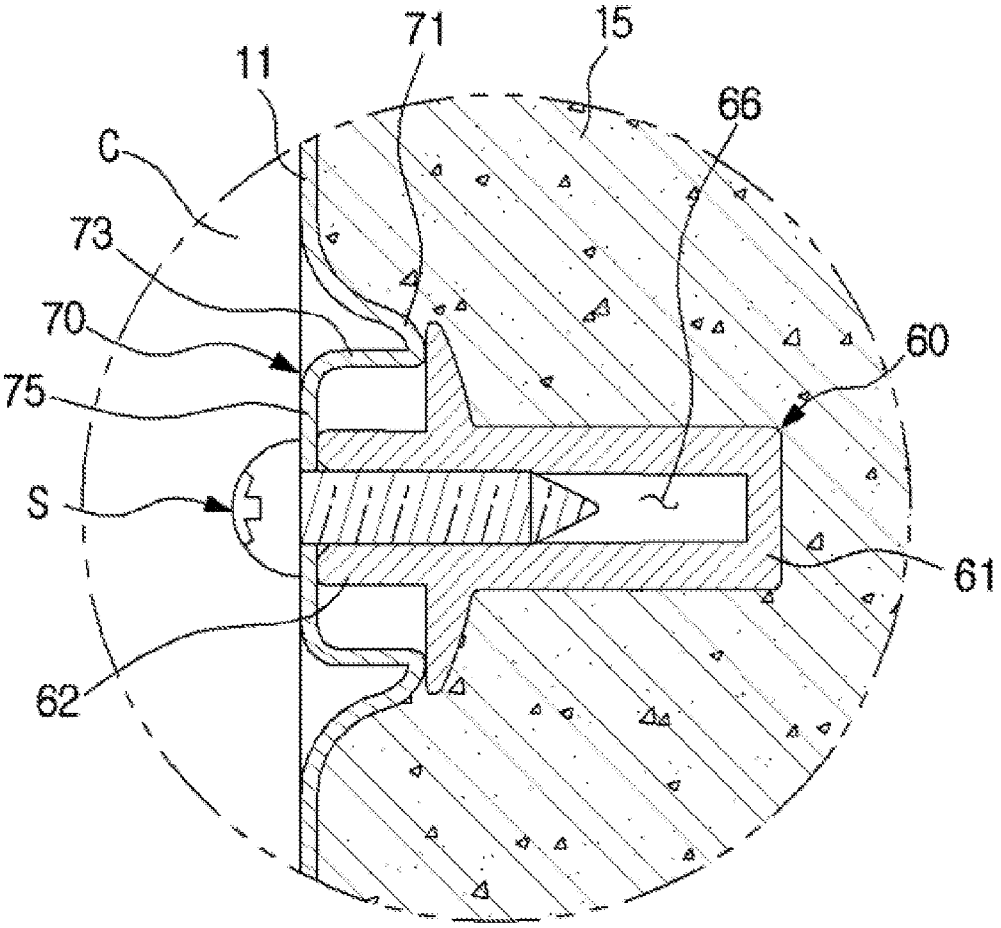
FIG. 3 is a view of a case where screws are fastened to screw fastening portions to which screw fixing members are coupled, in accordance with an embodiment of the present disclosure.
Figure 4:
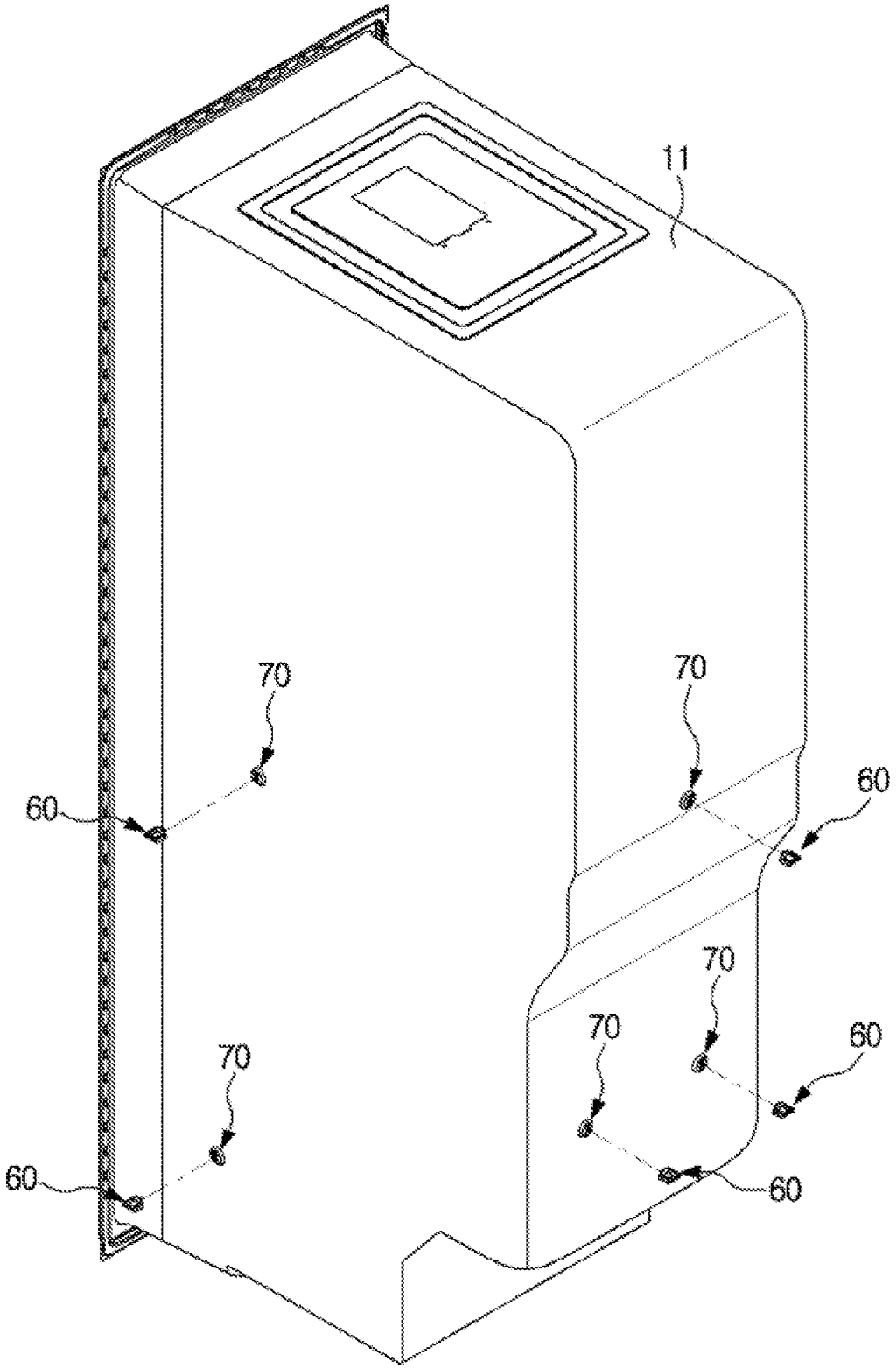
FIG. 4 is a view of a case where the screw fixing members are coupled to the screw fastening portions disposed in an inner case of the refrigerator in accordance with an embodiment of the present disclosure.

As illustrated in FIGS. 2 through 4, a plurality of components C are disposed in the storage compartment 20. The plurality of components C may be fixed to the inner case 11 using screws S.

The components C are fastened to the inner case 11 using the screws S. A plurality of screw fastening portions 70, to which the screws S are fastened, are disposed in the inner case 11.

Because the inner case 11, in which the plurality of screw fastening portions 70 are disposed, is manufactured by forming a resin material, the inner case 11 has weak rigidity. Thus, when the screws S are fastened to the screw fastening portions 70, the screws S are not firmly fixed into the inner case 11 so the components C disposed in the storage compartment 20 may detach from the inner case 11 and may drop onto a bottom of the storage compartment 20.

Thus, a plurality of screw fixing members 60 for fixing the screws S are coupled to the screw fastening portions 70 at an outside of the inner case 11.

Figure 5:
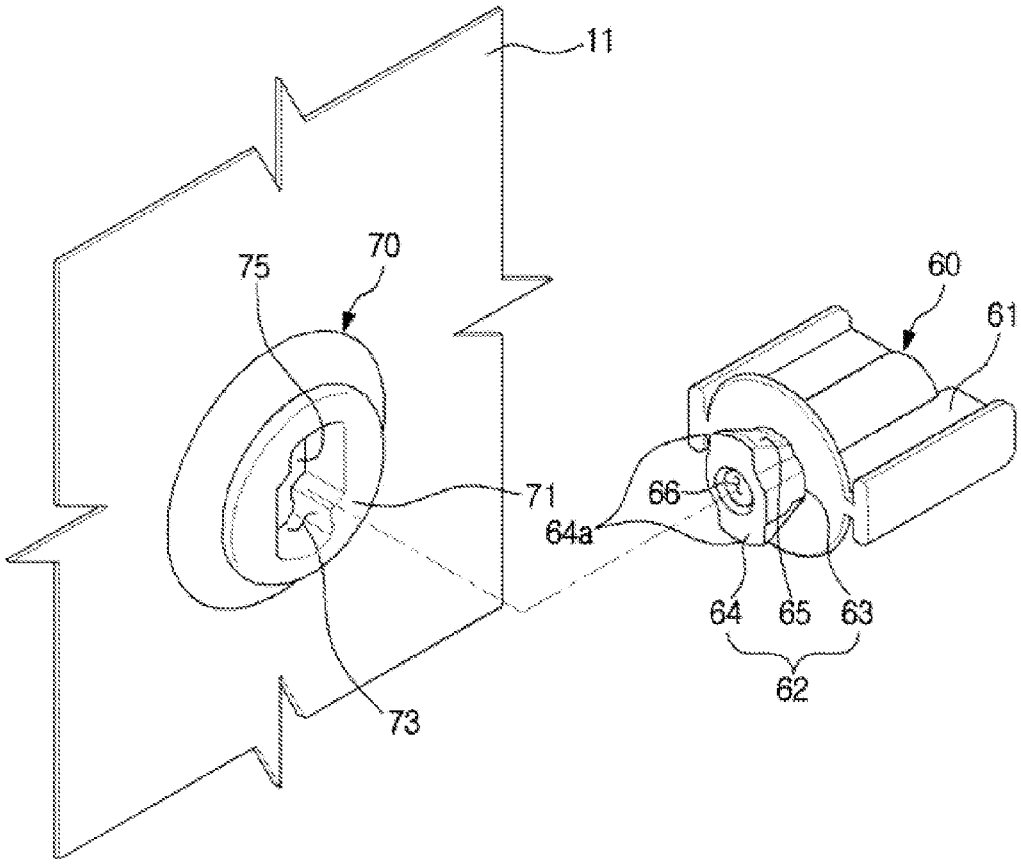
FIG. 5 is a view of a case where the screw fixing members are coupled to the screw fastening portions in accordance with an embodiment of the present disclosure.

As illustrated in FIGS. 4 and 5, the plurality of screw fixing members 60 are coupled to the plurality of screw fastening portions 70 provided at the outside of the inner case 11.

Each of the screw fixing members 60 includes a body portion 61, a coupling portion 62 disposed to protrude from the body portion 61 and coupled to each of the screw fastening portions 70, and a fixing groove 66 into which each of the screws S fastened to the screw fastening portions 70 is inserted and fixed.

The body portion 61 is disposed so that a user may grasp the body portion 61. The coupling portion 62 is disposed to protrude from the body portion 61 in a direction in which the screw fixing members 60 are coupled to the screw fastening portions 70. The coupling portion 62 is inserted into a coupling groove 73 of each of the screw fastening portions 70 that will be described below.

When each screw fixing member 60 is coupled to each screw fastening portion 70, if the coupling portion 62 is inserted into the coupling groove 73, the user grasps the body portion 61 and then rotates the body portion 61 so that the screw fixing members 60 may be coupled to the screw fastening portions 70. An operation in which the screw fixing members 60 are coupled to the screw fastening portions 70 will be described below.

The coupling portion 62 includes a first coupling portion 63 that is in contact with the body portion 61, a second coupling portion 64 that is spaced apart from the body portion 61, and an inclined surface 65 which is provided between the first coupling portion 63 and the second coupling portion 64 and a cross section of which extends in a direction in which the screw fixing member 60 is coupled to the screw fastening portion 70.

A pair of inclined surfaces 65 are provided to be symmetrical with each other. A pair of hanging portions 64*a* are disposed in a portion of the second coupling portion 64 in which the pair of inclined surfaces 65 and the second coupling portion 64 are connected to each other.

The pair of hanging portions 64*a* may be disposed in the second coupling portion 64 to have a shape in which the pair of hanging portions 64*a* protrude outwardly more than the first coupling portion 63 in a radial direction of the fixing groove 66.

When the fixing groove 66 is disposed in the center of the coupling portion 62 and the body portion 61 and the screws S are fastened to the screw fastening portions 70 in a state in which the screw fixing members 60 are coupled to the screw fastening portions 70, a part of the screws S is inserted into the fixing groove 66 and thus the screws S are fixed to prevent movement.

A plurality of screw fastening portions 70 are disposed in the inner case 11 so that the screws S for fixing the components C disposed in the storage compartment 20 may be fastened to the plurality of screw fastening portions 70. The screw fixing members 60 for fixing the screws S fastened to the screw fastening portions 70 may also be coupled to the screw fastening portions 70 at an outside of the inner case 11.

Each of the screw fastening portions 70 includes a bead 71 that protrudes convexly from the outside of the inner case 11, a coupling groove 73 disposed in the bead 71 so that the coupling portion 62 of each screw fixing member 60 is inserted into and coupled to the coupling groove 73, and a blocking layer 75 that forms a bottom surface of the coupling groove 73.

The bead 71 is disposed to protrude convexly from the outside of the inner case 11 so that the coupling groove 73 having a predetermined depth may be disposed in the bead 71.

The coupling groove 73 is disposed in the bead 71 to be recessed toward the inside of the inner case 11. The coupling groove 73 has a shape corresponding to the coupling portion 62 so that the coupling portion 62 of the screw fixing member 60 may be inserted into the coupling groove 73.

Because the second coupling portion 64 of the coupling portion 62 inserted into the coupling groove 73 is larger than the first coupling portion 63, the coupling groove 73 has a shape corresponding to the second coupling portion 64 so that the second coupling portion 64 may be inserted into the coupling groove 73. The coupling groove 73 is disposed to be recessed by an interval between the first coupling portion 63 and the second coupling portion 64 so that the coupling portion 62 may be inserted into and accommodated in the coupling groove 73.

Sides of the coupling groove 73 are formed to have flexibility and are disposed so that the shape of the coupling groove 73 may be deformed by the coupling portion 62 when the coupling portion 62 inserted into the coupling groove 73 is rotated.

The blocking layer 75 forms the bottom surface of the coupling groove 73 and blocks the storage compartment 20 that is the inside of the inner case 11 from the outside of the inner case 11.

After the screw fixing members 60 are coupled to the screw fastening portions 70 disposed in the inner case 11, a space between the inner case 11 and the outer case 13 is filled with the insulating material 15. Thus, the insulating material 15 may be prevented from leaking into the storage compartment 20 by using the blocking layer 75 that forms a barrier between the inside and the outside of the inner case 11.

Because the blocking layer 75 that prevents the insulating material 15 from leaking into the storage compartment 20 is formed as a thin film, when the screws S are fastened to the screw fastening portions 70, the blocking layer 75 is penetrated by the screws S so that each screw S may be inserted into the fixing groove 66 of each screw fixing member 60.

Next, a procedure in which, after the screw fixing members 60 are coupled to the screw fastening portions 70, the screws S are fastened to the screw fastening portions 70, will be described with reference to FIGS. 6 through 10.

Before the space between the inner case 11 and the outer case 13 is filled with the insulating material 15, the screw fixing members 60 are coupled to the screw fastening portions 70 disposed in the inner case 11. After the screw fixing members 60 are coupled to the screw fastening portions 70, the space between the inner case 11 and the outer case 13 is filled with the insulating material 15.

Figure 6:
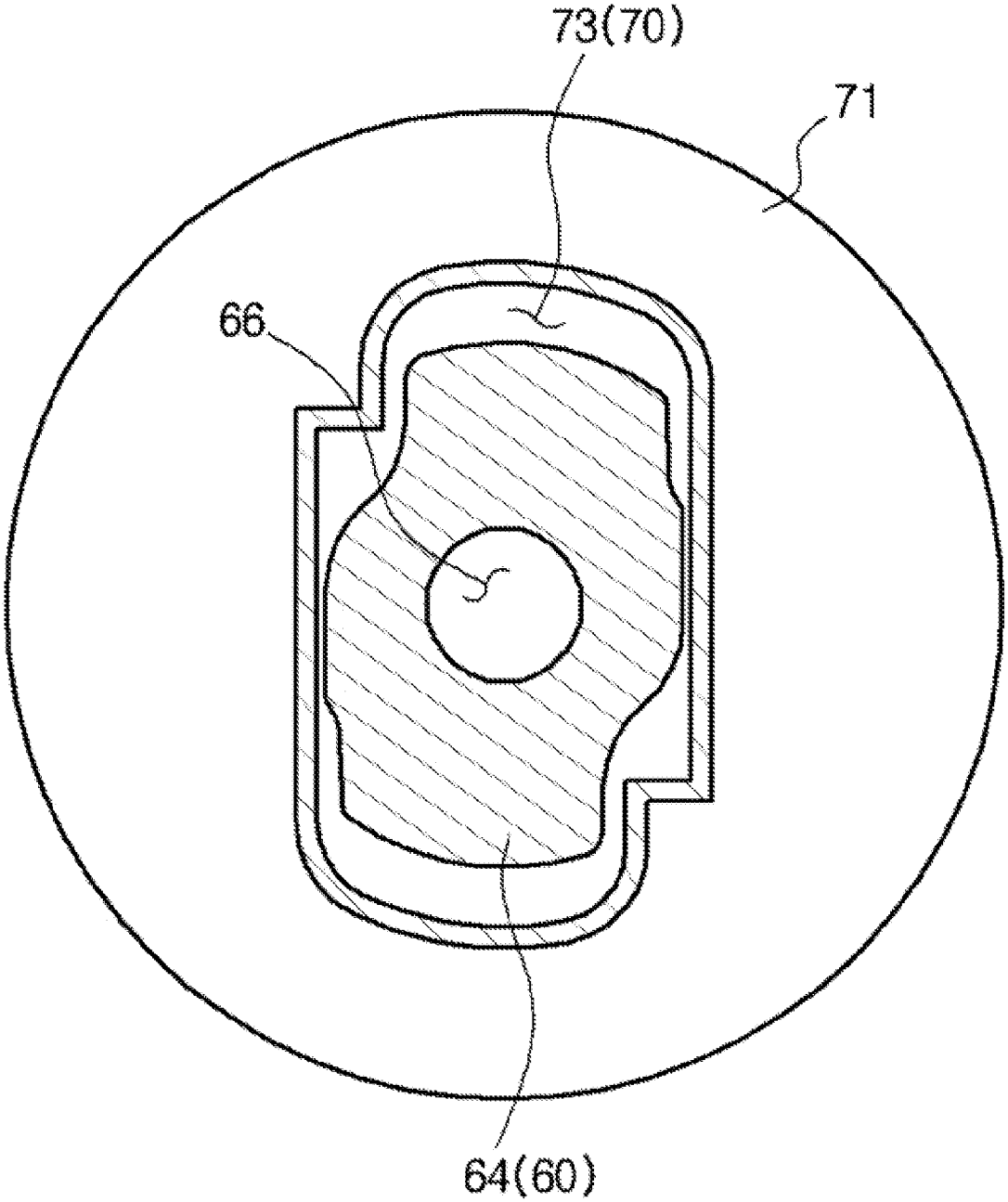
FIG. 6 is a view of a case where coupling portions of the screw fixing members are inserted into coupling grooves of the screw fastening portions in accordance with an embodiment of the present disclosure.

As illustrated in FIG. 6, when the screw fixing members 60 are coupled to the screw fastening portions 70 disposed in the inner case 11, the coupling portion 62 is inserted into the coupling groove 73 so that the second coupling portion 64 of each screw fixing member 60 may correspond to the coupling groove 73 of each screw fastening portion 70.

Figure 7:
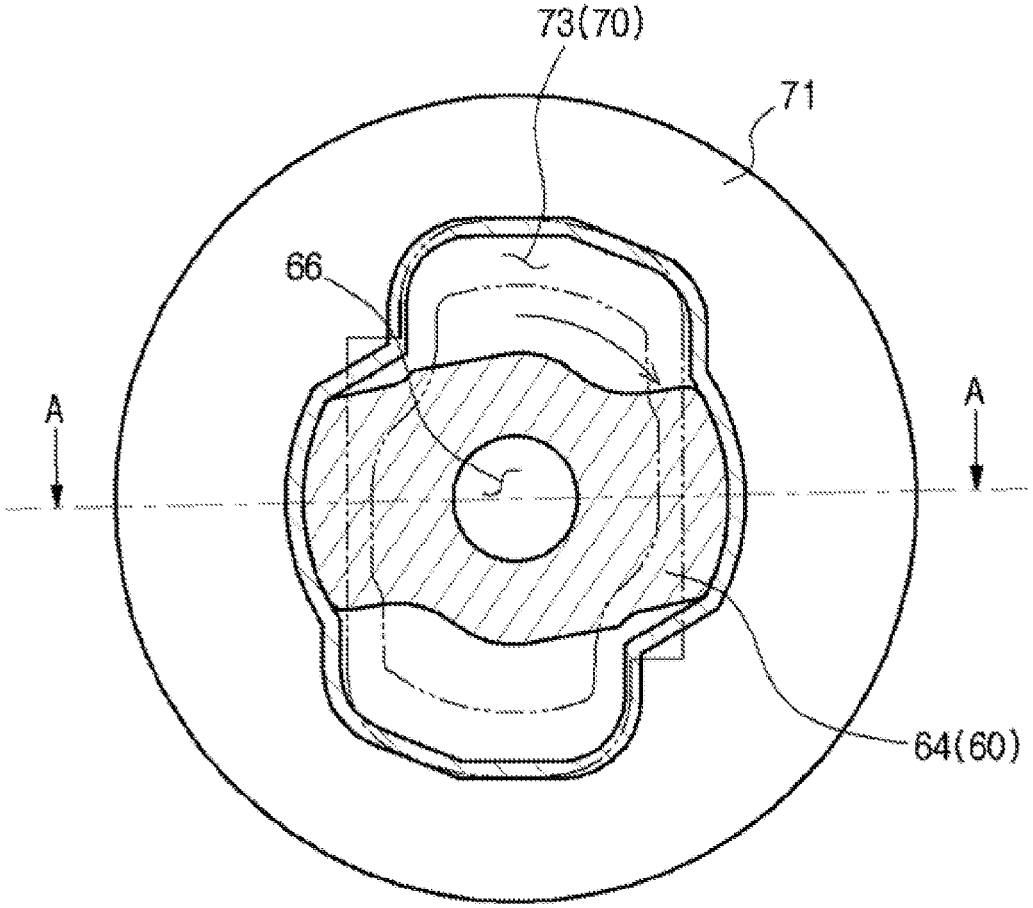
FIG. 7 is a view of a case where the screw fixing members are coupled to the screw fastening portions when the coupling portions illustrated in FIG. 6 are rotated and thus sides of the coupling grooves are deformed.

After the coupling portion 62 is inserted into the coupling groove 73, as illustrated in FIG. 7, the screw fixing members 60 are rotated so that the coupling portion 62 may be rotated.

When the screw fixing members 60 are rotated, the sides of the coupling groove 73 have flexibility and thus are deformed to correspond to a shape of the inclined surface 65 disposed in the coupling portion 62.

Figure 8:
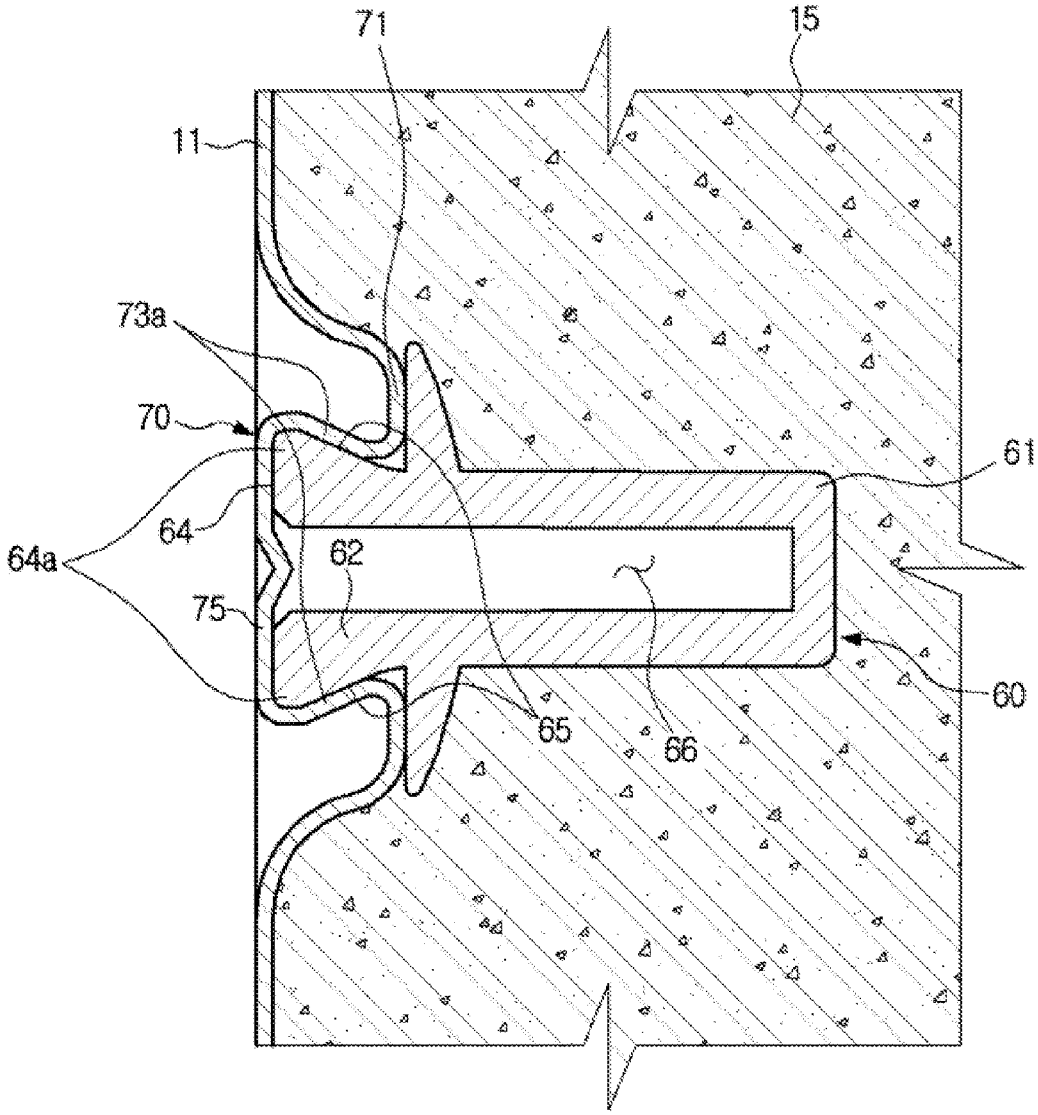
FIG. 8 is a cross-sectional view taken along a line A-A of FIG. 7.

When the sides of the coupling groove 73 are deformed to correspond to the shape of the inclined surface 65, a hanging groove 73*a* is disposed in the coupling groove 73, as illustrated in FIG. 8.

When the hanging groove 73*a* is disposed in the coupling groove 73, the hanging portions 64*a* of the coupling portion 62 are hung in the hanging groove 73*a* so that the screw fixing members 60 may be coupled to the screw fastening portions 70 and prevented from escaping from the screw fastening portions 70.

Figure 9:
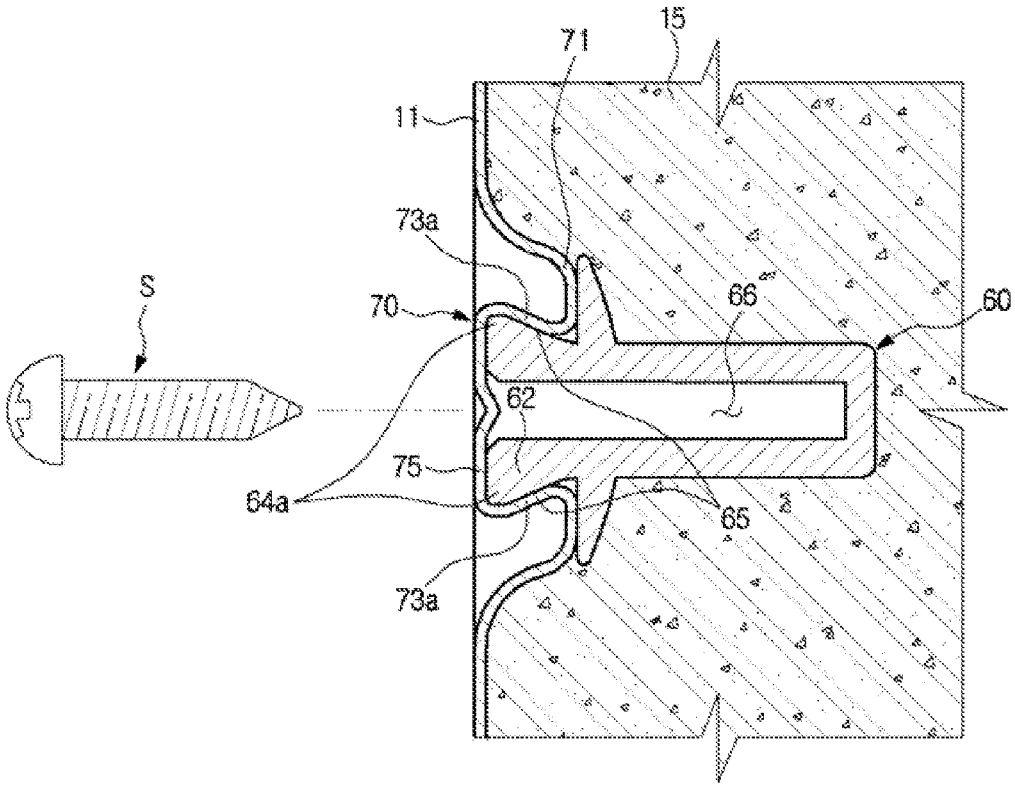
FIG. 9 is a view of a case where the screws are fastened to the screw fastening portions to which the screw fixing members are coupled, in accordance with an embodiment of the present disclosure.

When the screw fixing members 60 are coupled to the screw fastening portions 70, the screws S are fastened to the screw fastening portions 70, as illustrated in FIG. 9.

Figure 10:
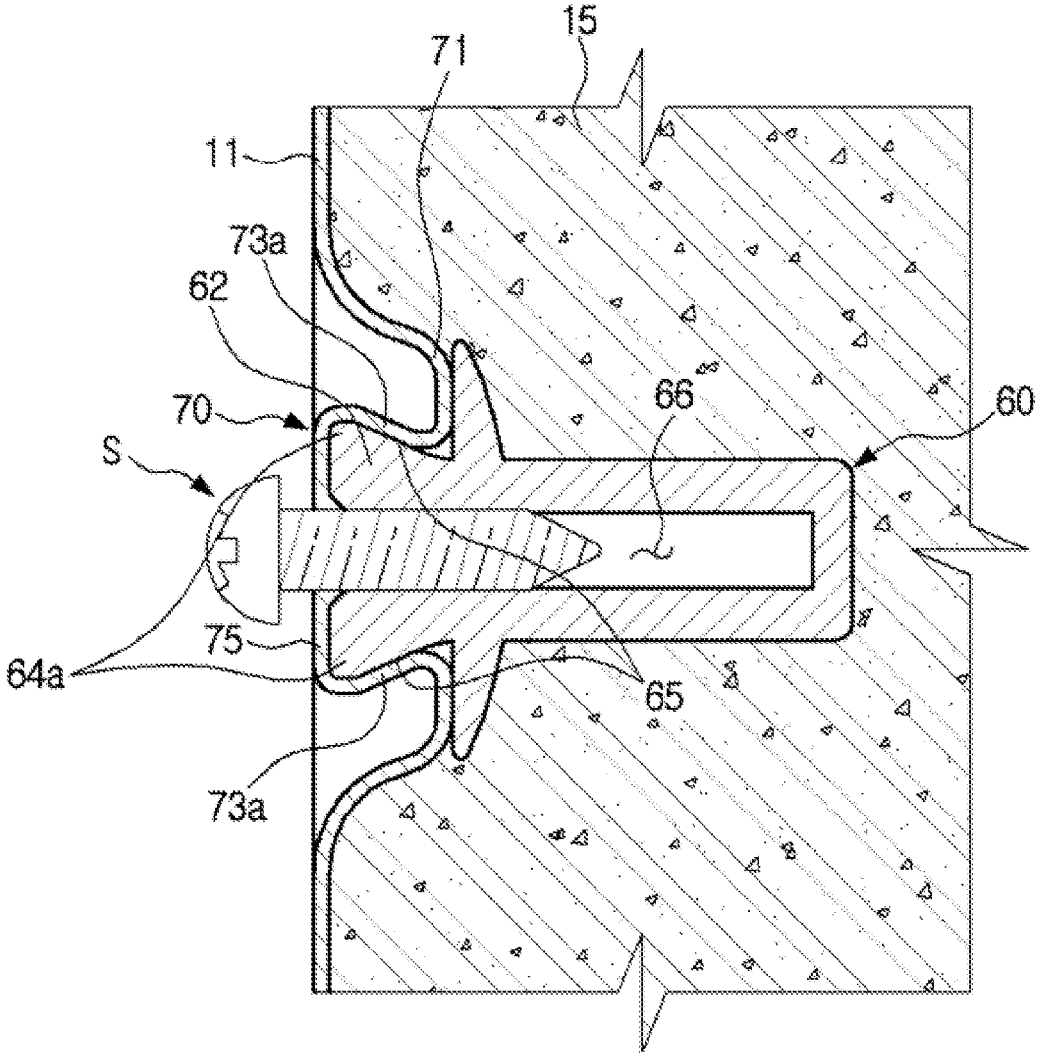
FIG. 10 is a view of a case where the screws are fastened to the screw fastening portions in FIG. 9 and are fixed by the screw fixing members.

When the screws S are fastened to the screw fastening portions 70, the blocking layer 75 of each screw fastening portion 70 is penetrated by each screw S, and each screw S is inserted into and fixed into the fixing groove 66, as illustrated in FIG. 10.

As described above, because the blocking layer 75 is disposed in each screw fastening portion 70, when the space between the inner case 11 and the outer case 13 is filled with the insulating material 15, the insulating material 15 is prevented from leaking into the storage compartment 20 by using the blocking layer 75, and when the screws S are fastened to the screw fastening portions 70, the blocking layer 75 formed as the thin film is penetrated by each screw S so that the screws S may be fixed by the screw fixing members 60.

As described above, in accordance with embodiments of the present disclosure, an insulating material can be prevented from leaking into a storage compartment, and an additional sealing operation is omitted so that productivity can be improved.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an inner case having a storage compartment formed therein;

an outer case coupled to an outside of the inner case and forming an exterior of the refrigerator;

an insulating material filling a space between the inner case and the outer case;

a screw fixing a component disposed in the storage compartment to the inner case;

a screw fixing member coupled to an outer surface of the inner case and fixing the screw fastened at an inside of the inner case; and a screw fastening portion disposed in the inner case and having a coupling groove so that the screw fixing member is inserted into and coupled to the coupling groove, wherein the screw fastening portion has a blocking layer that blocks the storage compartment from the outside of the inner case and is penetrated by the screw when the screw is fastened to the screw fastening portion.

2. The refrigerator of claim 1, wherein the screw fixing member comprises a body portion, a coupling portion disposed to protrude from the body portion and coupled to each of the screw fastening portions, and a fixing groove disposed in the center of the coupling portion and the body portion so that the screw is inserted and fixed into the fixing groove.

3. The refrigerator of claim 2, wherein the coupling portion has an inclined surface, a cross section of which extends in a direction in which the screw fixing members are coupled to the screw fastening portions.

4. The refrigerator of claim 3, wherein the coupling portion comprises a first coupling portion that is in contact with the body portion and a second coupling portion that is spaced apart from the body portion and having the inclined surface between the first coupling portion and the second coupling portion.

5. The refrigerator of claim 4, wherein a pair of inclined surfaces are disposed to be symmetrical with each other so that the second coupling portion has a pair of hanging portions that protrude outwardly more than the first coupling portion in a radial direction of the fixing groove.

6. The refrigerator of claim 5, wherein the screw fastening portion comprises a bead that protrudes from the outside of the inner case, the coupling groove disposed in the bead so that the coupling portion of the screw fixing member is inserted into and coupled to the coupling groove, and a blocking layer that forms a bottom surface of the coupling groove.

7. The refrigerator of claim 6, wherein the coupling groove has a shape corresponding to the second coupling portion so that the second coupling portion is capable of being inserted into the coupling groove, and the coupling groove is disposed to be recessed by an interval between the first coupling portion and the second coupling portion.

8. The refrigerator of claim 7, wherein sides of the coupling groove are formed to have flexibility and are deformed to have a hanging groove corresponding to a shape of the inclined surface when the body portion is rotated after the coupling portion is inserted into the coupling groove.

9. The refrigerator of claim 8, wherein, when the screw fixing member is rotated and coupled to the screw fastening portion, the pair of hanging portions are hung in the hanging groove so that the screw fixing member is prevented from escaping from the screw fastening portion.

10. The refrigerator of claim 2, wherein, when the screw is fastened to the screw fastening portion, the screw penetrates the blocking layer and is inserted and fixed into the fixing groove.

11. The refrigerator of claim 1, wherein the space between the inner case and the outer case is filled with the insulating material after the screw fixing member is coupled to the screw fastening portion.

12. The refrigerator of claim 1, wherein the blocking layer prevents the insulating material from leaking into the storage compartment.

13. A refrigerator comprising:

an inner case having a storage compartment formed therein;

an outer case coupled to an outside of the inner case and forming an exterior of the refrigerator;

an insulating material filling a space between the inner case and the outer case;

a screw fixing a component disposed in the storage compartment to the inner case;

a screw fastening portion having a coupling groove in an outer surface of the inner case; and a screw fixing member coupled to the screw fastening portion and fixing the screw that penetrates the inner case in a bottom surface of the coupling groove and fastened to the screw fastening portion in the inner case, wherein the screw fixing member has a coupling portion inserted into the coupling groove, and when the screw fixing member is rotated in a state in which the coupling portion is inserted into the coupling groove, the coupling portion is fixed into the coupling groove so that the screw fixing member is prevented from escaping from the screw fastening portion.

14. The refrigerator of claim 13, wherein the screw fastening portion comprises a bead protruding from the outside of the inner case, a coupling groove disposed in the bead to be recessed in a direction of an inside of the inner case, and a blocking layer that forms a bottom surface of the coupling groove.

15. The refrigerator of claim 14, wherein the screw fixing member comprises a body portion, a coupling portion disposed to protrude from the body portion and coupled to the coupling groove, and a fixing groove disposed in the center of the coupling portion and the body portion so that the screw is inserted and fixed into the fixing groove.

16. The refrigerator of claim 14, wherein the blocking layer prevents the insulating material from leaking into the storage compartment.

* * * * *